United States Patent [19]

Larsson

[11] 4,223,605

[45] Sep. 23, 1980

[54] FUSE

[76] Inventor: Gustaf A. Larsson, Bokbindarvägen 1, S-632 22 Eskilstuna, Sweden

[21] Appl. No.: 941,972

[22] Filed: Sep. 13, 1978

[30] Foreign Application Priority Data

Sep. 20, 1977 [SE] Sweden ..... 7710491

[51] Int. Cl.[3] ..... F42C 19/00; C06C 5/04

[52] U.S. Cl. ..... 102/27 R

[58] Field of Search ..... 102/27 R, 27 F, 29, 102/99; 89/27 B

[56] References Cited

U.S. PATENT DOCUMENTS

| | | | |
|---|---|---|---|
| 2,938,432 | 5/1960 | Grandy et al. | 89/27 B |
| 3,027,839 | 4/1962 | Grandy et al. | 102/27 R |
| 3,407,736 | 10/1968 | Beuschel | 102/99 |
| 3,590,739 | 7/1971 | Persson | 102/27 R |

FOREIGN PATENT DOCUMENTS

| | | | |
|---|---|---|---|
| 2820855 | 12/1978 | Fed. Rep. of Germany | 102/27 R |

*Primary Examiner*—David H. Brown
*Attorney, Agent, or Firm*—Fleit & Jacobson

[57] ABSTRACT

A fuse for transfer of a detonation from an explosive charge to another or for initiating or igniting a detonation in an explosive charge. The fuse has the shape of a hose forming a channel having a thin layer of a reactive substance on its inner surface.

In order to prevent any throttling of the channel a pyrotechnic charge is inserted into each end of the hose.

2 Claims, 1 Drawing Figure

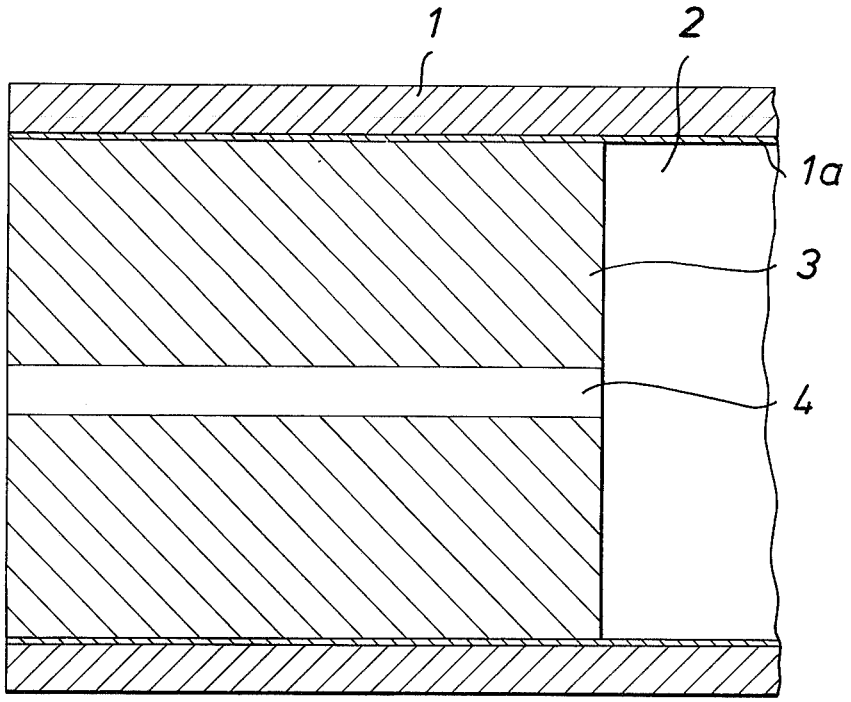
1
2
1a
3
4

FUSE

FIELD OF THE INVENTION

The present invention relates to a fuse for transfer of a detonation from an explosive charge to another or for initiating a detonation in an explosive charge.

PRIOR ART

A fuse is known in accordance with the prior art portion of Claim 1 (U.S. Pat. No. 3,590,739) in which the fuse consists of an elongated wrapping the inner surface of which being covered by a thin layer of an explosive and/or other reactive substance such that a continuous gas channel is formed in which an initiated detonation can propagate in the longitudinal direction of the wrapping.

If a detonating cap is provided at one end of such known fuse a detonation wave will, upon ignition of the cap, propagate along the fuse. At the other end of the fuse there is provided a charge of black powder or an explosive which is ignited by the detonation wave.

It has now appeared that the fuse does not always function since a radial contraction of the fuse may occur causing a throttling of the gas channel. This often happens when the fuse and the explosive cap attached thereto is exposed to high temperatures. The throttling especially occurs at the end of the metal portions of the cap. Even after a few hours exposure to 60° C. the function of the fuse and explosive cap attached thereto has ceased. It has also appeared that a reduction of the radial dimension of the gas channel sometimes appears upon lengthy storing at normal temperture, the reduction being due to so-called cold flow.

It has been proposed to eliminate the disadvantage of said deficient function by the introduction of a metal sleeve into the end of the gas channel of the fuse in order to mechanically strengthen the fuse. However, it turned out that the throttling was not eliminated. A throttling instead appeared behind the metal sleeve, namely where the strengthening of the fuse was discontinued.

SUMMARY OF THE INVENTION

The invention as claimed is intended to provide a remedy. According to the invention a cylindrical solid block of a pyrotechnic charge is inserted into each end of the gas channel of the fuse. By using a pyrotechnic block in accordance with the invention any risk for throttling of the fuse is eliminated. It has also turned out the the charge of powder or explosive will be ignited faster by the detonation wave if such a pyrotechnic block is introduced into the fuse.

BRIEF DESCRIPTION OF THE DRAWING

One way of carrying out the invention is described in detail below with reference to the drawing, the only FIGURE of which shows a longitudinal section of one end of a fuse in accordance with the invention. Since the two ends of the fuse have the same shape only one of them is shown.

DESCRIPTION OF THE PREFERRED EMBODIMENT

The fuse consists of an outer wrapping 1 having the shape of a tube or hose suitably made of some flexible material.

One end of the fuse may be connected to a detonating cap of know type. Attached to the other end of the fuse may be a fuse-ignitible detonating cap also of conventional type. Such caps are for instance described in the above-identified U.S. Patent Specification.

Disposed on the interior wall of the tube 1 is a thin layer 1*a* of an explosive or other reactive substance. The explosive may for example be of the type described in the above-mentioned U.S. Patent Specification, or any other suitable reactive substance.

The tube 1 forms a longitudinally coherent, uninterrupted gas channel or duct 2 between the two ends of the tube.

A very hard-packed cylindric block 3 of a pyrotechnic charge, for example a black powder charge, is inserted into each end of the gas channel 2. The block has a bore 4 in order to achieve a faster function.

The block is hard-packed because it otherwise could not be inserted into the cavity of the fuse without being broken. Furthermore, it positively resists exterior stresses.

The pyrotechnic charge may for instance be made of boron and potassium nitrate with a suitable adhesive agent. Moisture resistant black powder charges may alternatively be used.

The block is inserted into the channel 2 of the fuse in such fitting relationship with the layer 1*a* that the block will be held in place only by the friction force between the block and layer 1*a*. Thus no glue or other joining means will be necessary for holding the block in a fixed position in the channel 2.

According to an embodiment of the invention the block had a length of 3.2 mm, a diameter of 1.35 mm and a bore having a diameter of 0.5 mm.

I claim:

1. A fuse consisting of a wall structure defining a hollow elongated tube forming a gas channel, means for sustaining a detonation wave along said gas channel, said means comprising a reactive substance distributed as a thin layer on the inner surface of said tube and being exposed to said channel, characterised in that the fuse has a cylindrical block of a pyrotechnic charge inserted into at least one end of the gas channel.

2. Fuse as claimed in claim 1, in which the block has a through bore in the longitudinal direction of the gas channel.

* * * * *